US005896699A

United States Patent [19]

Livingston et al.

[11] Patent Number: 5,896,699

[45] Date of Patent: Apr. 27, 1999

[54] SOLAR POWERED ROTATING PLANT SUPPORTS DEVICE

[75] Inventors: Howard F. Livingston, Lancaster; Thomas R. Hecht, Manheim, both of Pa.

[73] Assignee: Home Gardener Manufacturing Co., Lititz, Pa.

[21] Appl. No.: 08/786,459

[22] Filed: Jan. 21, 1997

[51] Int. Cl.[6] ..... A47G 7/00

[52] U.S. Cl. ..... 47/39

[58] Field of Search ..... 47/39, 67, 65

[56] References Cited

U.S. PATENT DOCUMENTS

| | | | |
|---|---|---|---|
| 3,360,885 | 1/1968 | St. Clair | 47/39 |
| 4,026,067 | 5/1977 | Wengel . | |
| 4,051,627 | 10/1977 | Schilling, Jr. . | |
| 4,873,790 | 10/1989 | Laterza . | |
| 4,969,290 | 11/1990 | Skoretz . | |
| 5,079,645 | 1/1992 | Ritter . | |
| 5,152,099 | 10/1992 | Nilssen . | |
| 5,228,235 | 7/1993 | Ishimoto . | |
| 5,546,698 | 8/1996 | Rock | 47/39 |

FOREIGN PATENT DOCUMENTS

| | | | |
|---|---|---|---|
| 2495891 | 6/1982 | France | 47/39 |
| 2067837 | 7/1981 | United Kingdom | 47/39 |

*Primary Examiner*—Michael J. Carone
*Assistant Examiner*—Joanne C. Downs
*Attorney, Agent, or Firm*—Watson Cole Grindle Watson, P.L.L.C.

[57] ABSTRACT

Three plant support discs supported by a housing and are rotated so that the intermediate disc is rotated in one direction and the other two discs on either side thereof are rotated in opposite directions so that portions of plants on adjacent discs which overlap one another move in the same direction to cause such portions to gently mesh with one another and avoid damage. A solar cell array provides electrical power for driving an electric motor which in turn drives the discs through a drive train. The discs have projections which pass through slots in gears of the drive train to provide a slidable drive connection between the discs and the gears, while the lower ends of the projections support the discs on a support surface of the housing, thereby minimizing the loading on the gears.

12 Claims, 6 Drawing Sheets

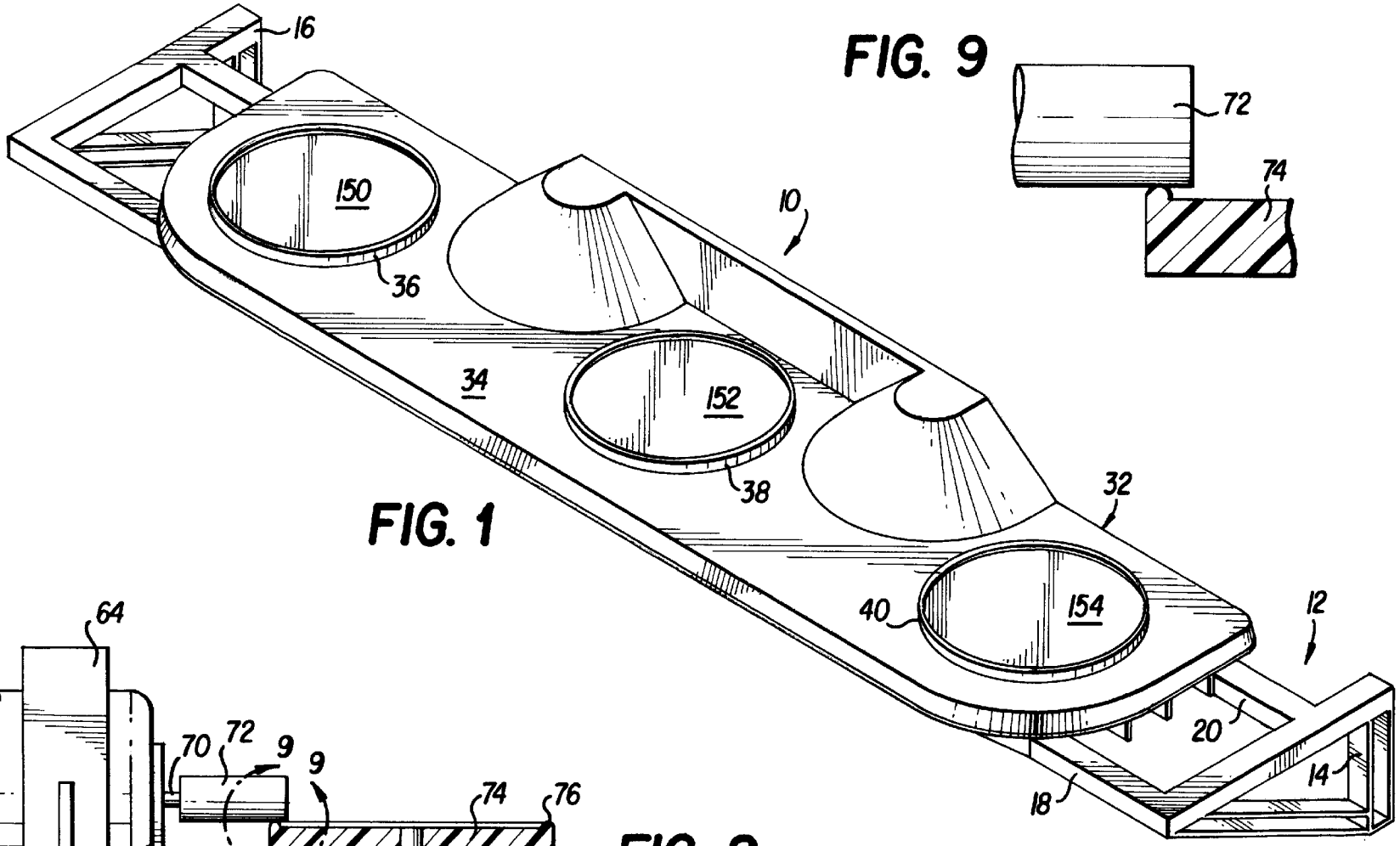
FIG. 1
FIG. 9
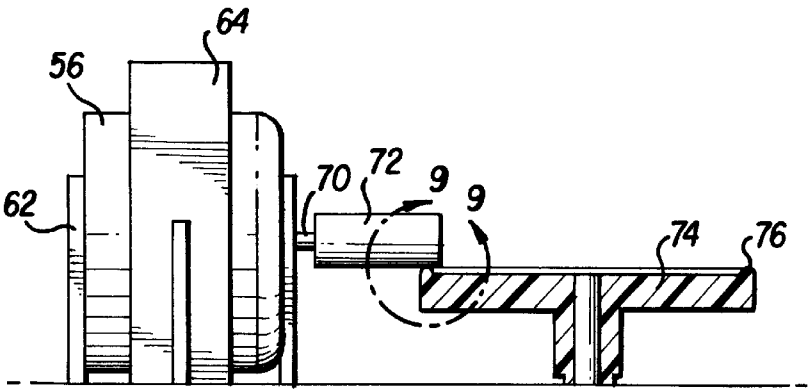
FIG. 8

FIG. 7
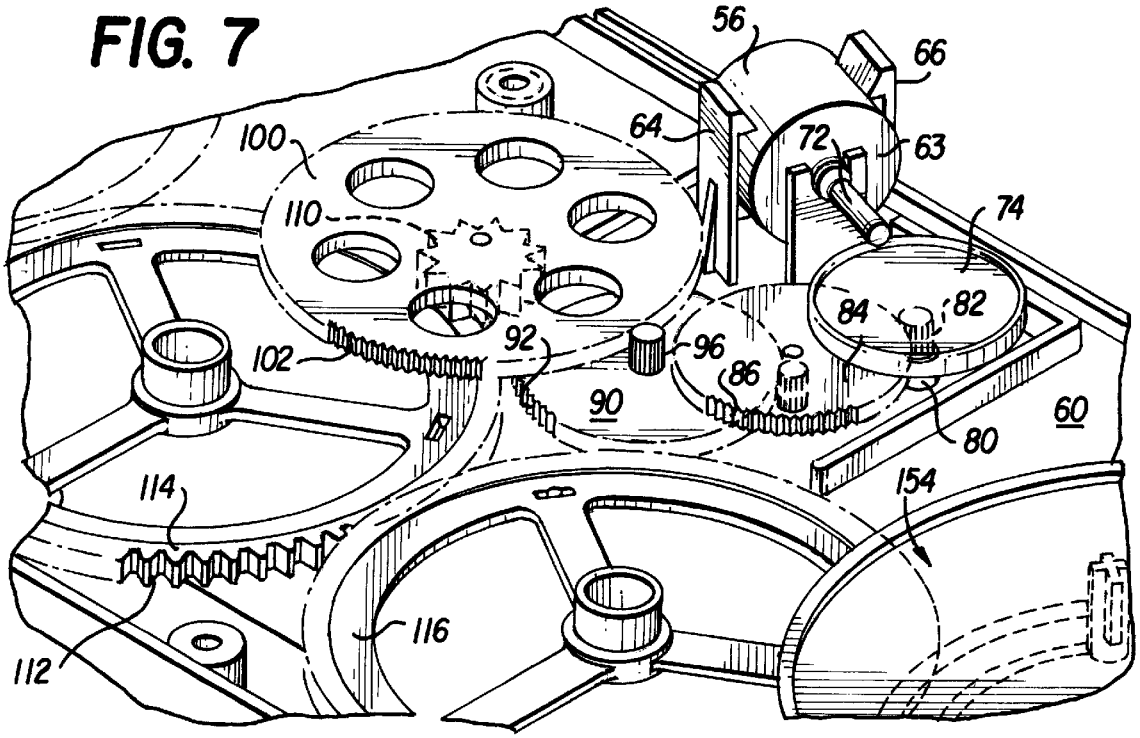
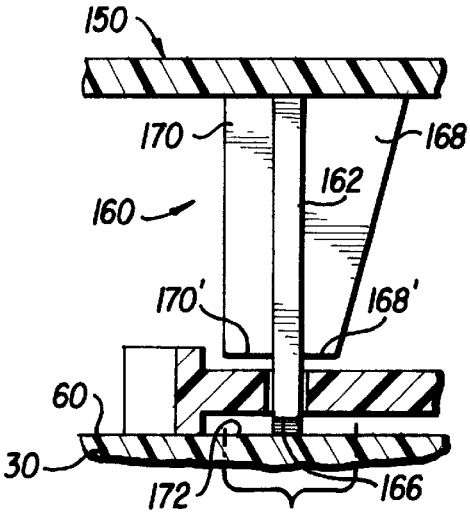
FIG. 12
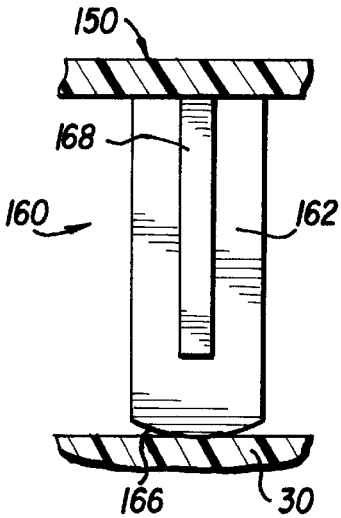
FIG. 13

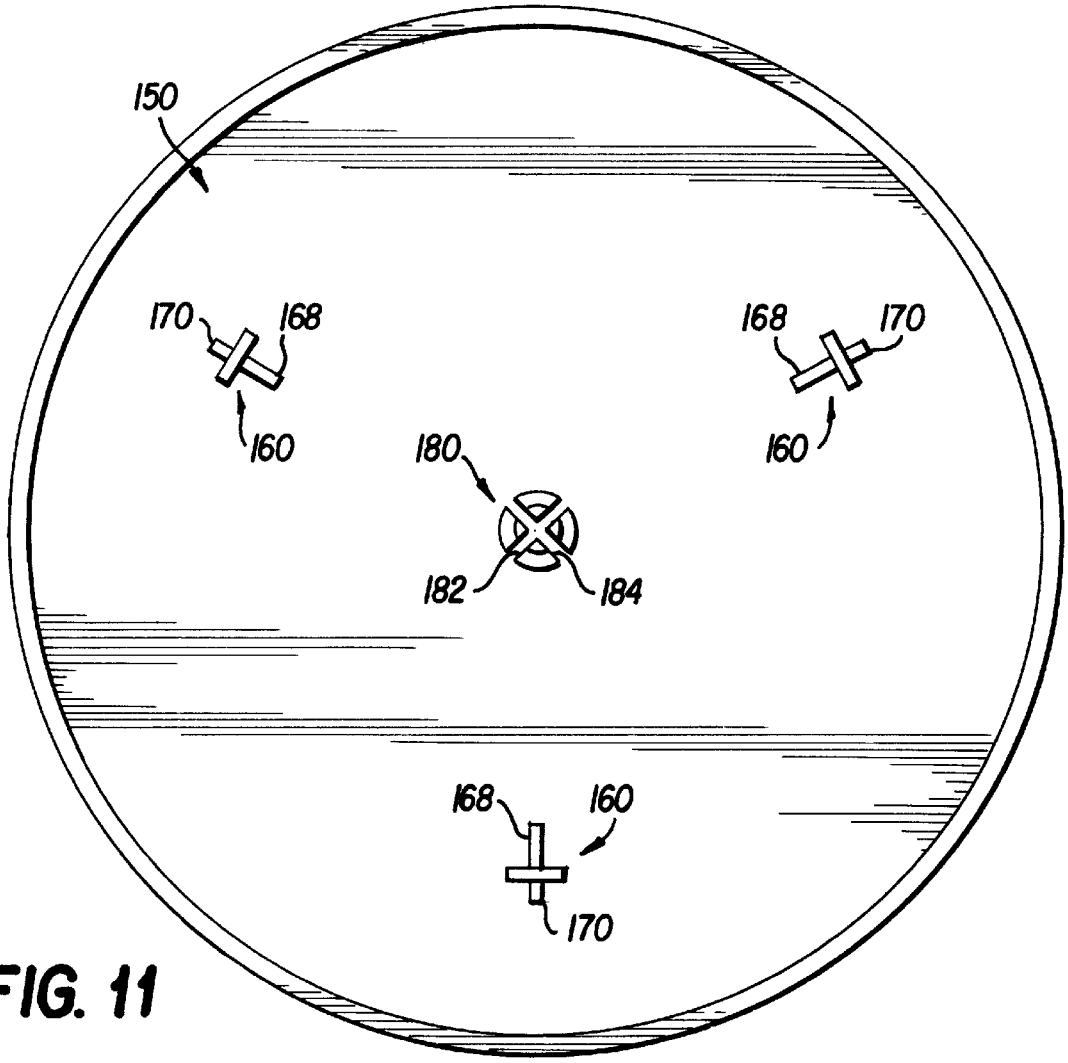
FIG. 11
FIG. 10
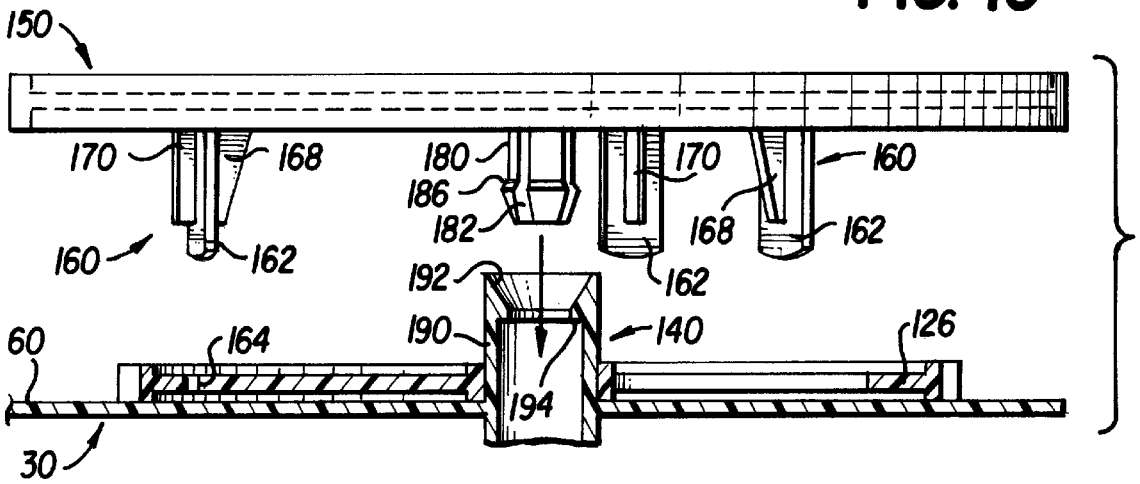

SOLAR POWERED ROTATING PLANT SUPPORTS DEVICE

BACKGROUND OF THE INVENTION

The present invention relates to a solar powered rotating plant supports device which is adapted to rotate potted plants so that the plants are equally exposed on all sides to sunlight thereby ensuring that the plants will grow straighter, taller and more lush than if the plants were not rotated. It is therefore desirable to provide a device which automatically turns plants whenever the sun is shining.

It is further desirable to utilize solar power to operate the device, thereby providing very energy efficient operation. The device should be capable of providing sufficient power to operate the device in both direct sunlight and bright indirect sunlight. Prior art devices have been developed for similar purposes. For example, U.S. Pat. Nos. 4,969,290 and 4,873,790 disclose solar powered devices for rotating potted plants. U.S. Pat. No. 5,228,235 discloses apparatus for rotating potted trees to promote generation of exhaled organic compounds from the trees.

A particular feature of all of these patented structures is that adjacent plants are rotated in the same direction. As a result, any overlapping portions of the plants which may engage one another are moving in opposite directions which will cause the overlapping portions to push on one another and create damage by bending portions of the plants. In fact, U.S. Pat. No. 5,228,235 specifically teaches that adjacent trees are rotated in the same direction so that the trees will interfere with one another in order to promote the generation of exhaled organic compounds. This is an undesirable feature when potted plants are rotated near one another for the purposes of the present invention.

SUMMARY OF THE INVENTION

In the present invention, adjacent plants are rotated in opposite directions so that any overlapping portions of the plants are moving the same direction when then come into contact with one another. This ensures that the overlapping portions will gently intermesh with one another thereby minimizing any damage which may occur due to such contact.

Solar cell means provides sufficient power to operate the device in both direct sunlight and bright indirect sunlight. The plant supports or discs upon which the potted plants rest rotate at the same rate which may be typically about four revolutions per hour. The plant supports will rotate any time sunlight is present, ensuring that the phototropism (the tendency for plants to bend toward light) is minimized.

The solar cell produces electricity which drives a small DC motor. The motor's direct output of about 1700 RPM at very low torque is connected to a drive train which reduces the RPM and increases the power or torque through a plurality of stages. A plurality of transfer gears are drivingly connected in the drive train and are rotatably supported on a support surface formed on the housing of the device, thereby providing a very simple support arrangement.

A unique driving connection is provided between the plant supports which directly support the potted plants and the associated transfer gears. A slidable driving connection is provided so that the weight of the plant support is carried on the support surface of the housing thereby significantly reducing the loading of the transfer gear. This enables the transfer gear to be more economically manufactured. Means is also provided for limiting upward movement of each transfer gear which is slidably connected to one of said plant supports. The plant supports are detachably connected to the housing so that they can be removed when desired.

The projections extending from the plant supports have stop surfaces formed thereon which are normally spaced from the associated transfer gears. These stop surfaces are adapted to engage and limit upward movement of the associated transfer gears.

BRIEF DESCRIPTION OF THE DRAWINGS

FIG. 1 is a top perspective view showing the invention mounted on a suitable support rack;

FIG. 7 is an enlarged top perspective view of a portion of the structure shown in FIG. 6;

FIG. 8 is an enlarged view showing the drive connection between the electric motor and the first gear of the drive train to the plant supports;

FIG. 9 is a still further enlarged view of the drive connection shown in FIG. 8;

FIG. 10 is an exploded view of the manner in which a plant support is drivingly connected to a transfer gear of the drive train;

FIG. 11 is a bottom view of the plant support shown in FIG. 10;

FIG. 12 is an enlarged view showing the driving connection between a plant support and a transfer gear; and FIG. 13 is a side view partly in section of the structure shown in FIG. 12.

DESCRIPTION OF THE PREFERRED EMBODIMENT

Figure 2:
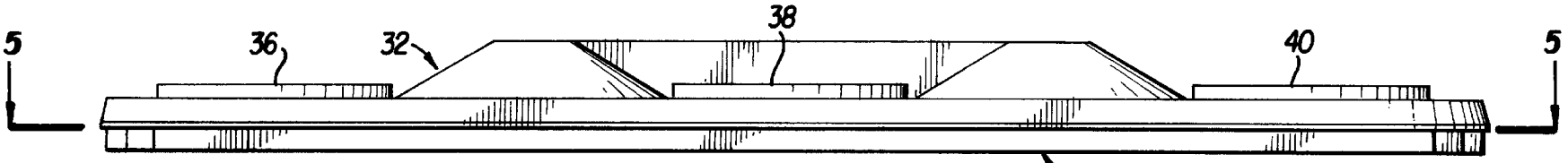
FIG. 2 is a front view of the invention shown in FIG. 1.

Referring now to the drawings wherein like reference characters designate corresponding parts throughout the several views, FIG. 1 illustrates the device 10 mounted on a suitable conventional support structure 12 including a pair of brackets 14 and 16 which are adapted to be supported on either side of a window so that the device is positioned close to the window to receive sunlight. The brackets may be connected to a wall or the like in the usual manner, and a plurality of cross-members 18 and 20 which may be adjustable in length are connected to the brackets. This support structure is conventional and forms no part of the invention.

Figure 3:
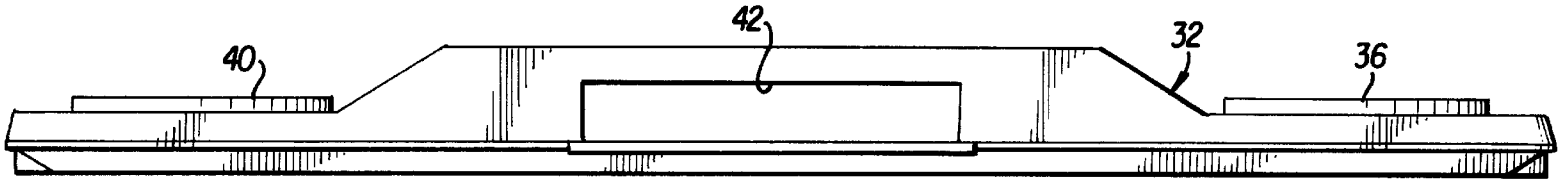
FIG. 3 is a rear view of the invention shown in FIG. 1.

The device includes a housing formed of an integral plastic base 30 and a an integral plastic cover 32 which has a depending peripheral lip (not shown) which is adapted to fit over an upstanding peripheral lip on the base hereinafter described to support the cover in the operative position shown. The cover includes three equally spaced holes through the upper surface 34 thereof which are defined by upstanding lips 36, 38 and 40 for receiving the plant supports of discs described below. As seen in FIG. 3, the cover is provided with a generally rectangular hole 42 which is disposed in operative position adjacent the solar cell array of the device so that sunlight can impinge on the array.

Figure 4:
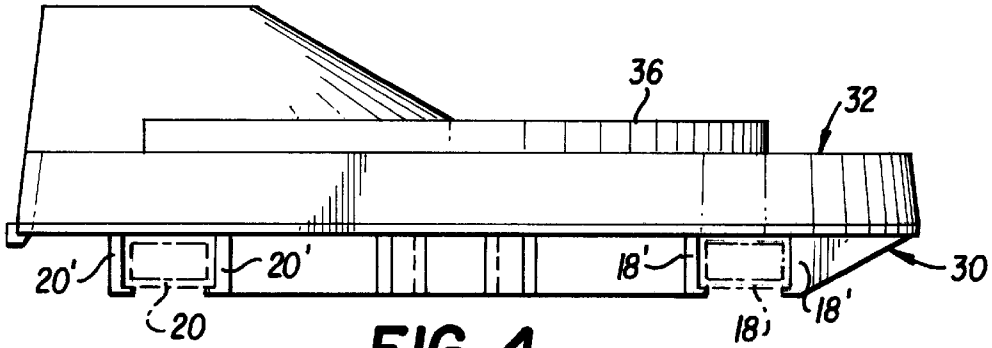
FIG. 4 is an end view of the invention shown in FIG. 1.
Figure 6:
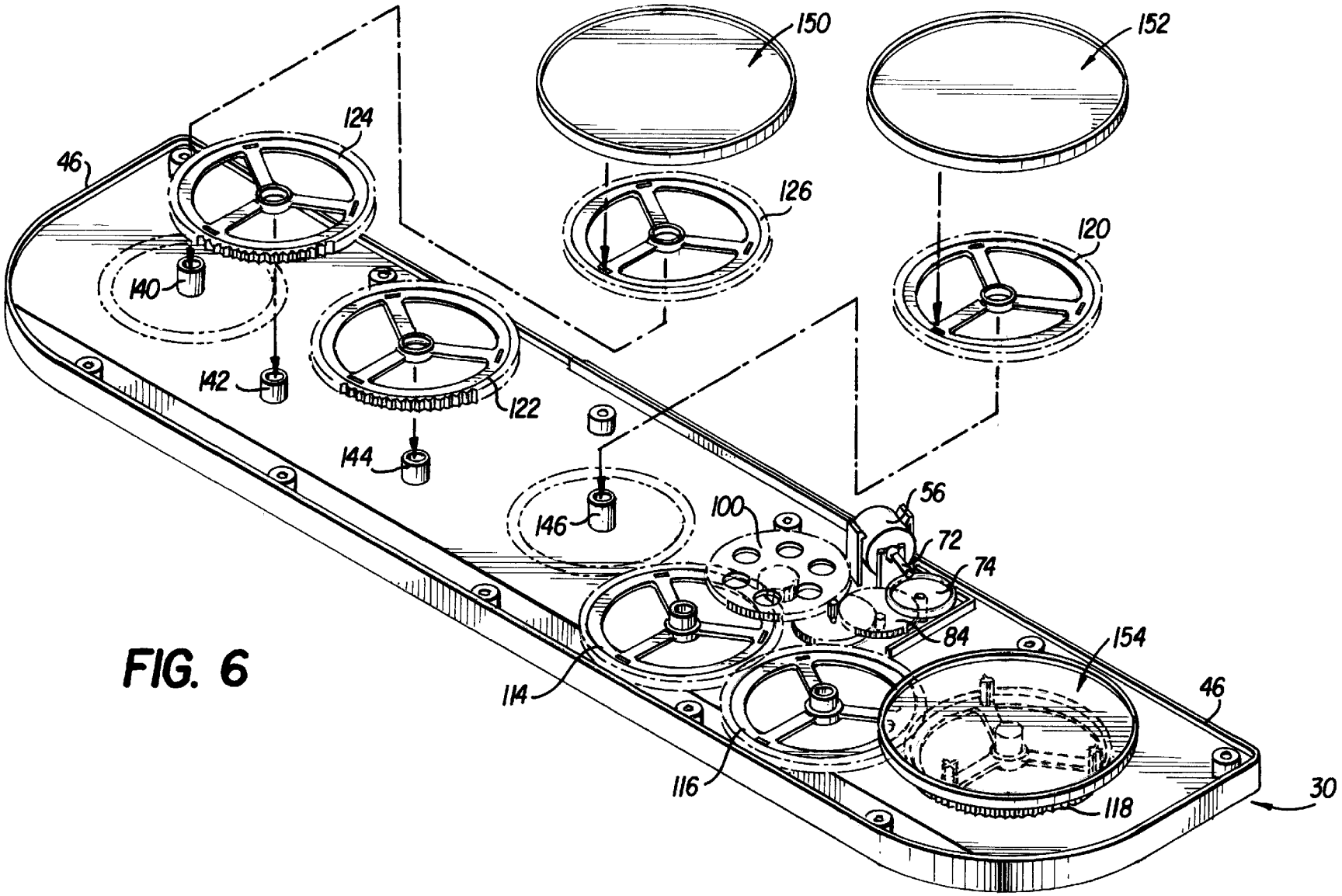
FIG. 6 is a top perspective view of the structure shown in FIG. 5 with certain elements shown in exploded relationship.

As seen in FIG. 4, the base 30 is provided with integral depending channel portions 20', 20' for receiving cross-member 20 and channel portions 18', 18' for receiving cross-member 18 to securely support the housing on the cross-members. It should be understood that any suitable configuration of the cross-members and channel members may be employed to support the housing in position. As seen in FIG. 6, the base is also provided with an integral upstanding peripheral lip 46 which is adapted to fit within the depending peripheral lip formed on the cover to support the cover in operative position.

Figure 5:
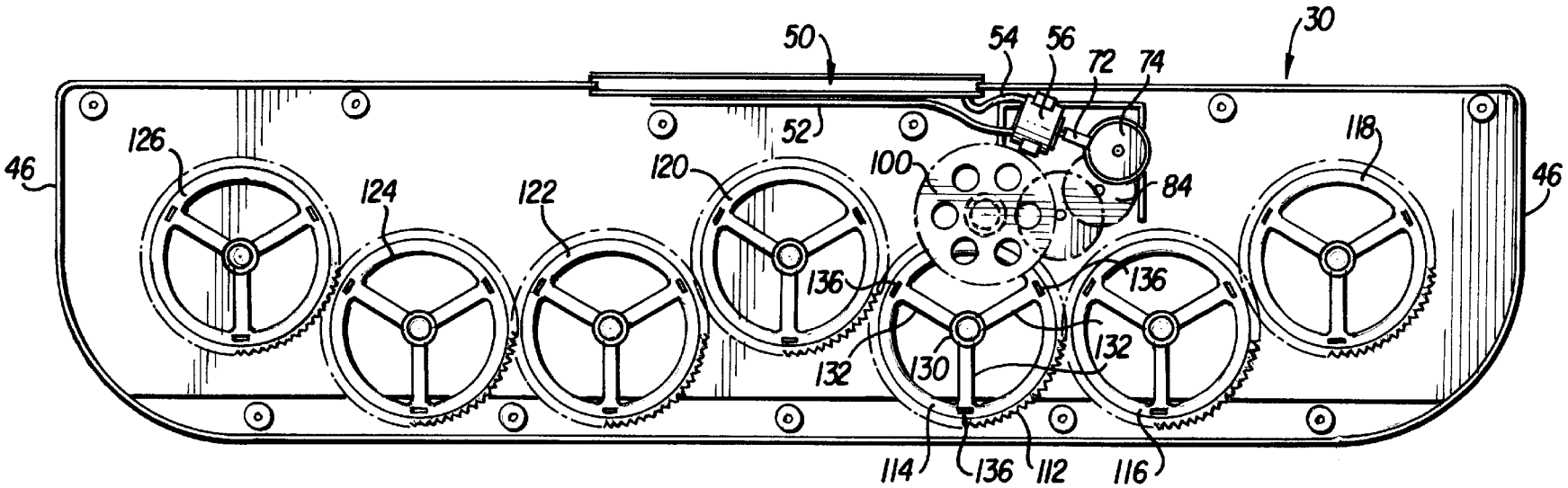
FIG. 5 is a view looking downwardly along the line 5—5 of FIG. 2 when the cover of the invention is removed.

As seen in FIG. 5, a conventional solar cell array 50 is supported by base 30 in position to be adjacent the hole 42 in the cover when the cover is mounted in position on the base. Array 50 is connected by electrical leads 52 and 54 to a conventional electric motor 56. As seen in FIGS. 7 and 8, the electric motor is mounted on a suitable integral mounting structure extending upwardly from the upwardly facing support surface 60 of base 30. The mounting structure includes a pair of similar spaced mounting portions 62 and 63 having semi-circular cutouts in the upper surfaces thereof for cradling motor 56. The mounting structure also includes a pair of brackets 64 and 66 which engage the upper part of the motor for holding the motor in position.

The motor 56 includes an output shaft 70 having a roller 72 formed of rubber or the like mounted thereon. The drive train of the device includes a first drive gear 74 the construction of which is clearly shown in FIG. 8. The gear includes a raised peripheral edge 76 which is rounded so as to provide a substantially line contact with roller 72 to minimize wear. This gear is formed of a suitable substance such as nylon which is wear resistant and which is suitable for the manufacture of precision items.

Gear 74 has a central hole 78 formed therethrough which is adapted to receive a steel pin (not shown) about which the gear rotates. The steel pin has a press fit in a suitable hole provided in base 30. An integral post 80 as seen in FIG. 7 extends upwardly from the support surface 60 of the base for limiting the downward movement of gear 74. Gear 74 also includes an integral pinion gear portion 82 which is adapted to engage a second drive gear 84.

As seen in FIG. 7, pinion gear portion 82 engages the gear teeth 86 on the outer periphery of gear 84. Gear 84 has a depending integral pinion gear portion 88 with a hole formed therethrough for receiving a steel pin (not shown) about which the gear rotates. The steel pin has a press fit in a suitable hole provided in base 30. Pinion gear portion 88 engages a third drive gear 90 having gear teeth 92 on the outer surface thereof in engagement with the gear teeth of pinion gear portion 88. It is noted that the undersurface of pinion gear portion 88 and the bottom surface of gear 90 are both supported on the support surface 60 of base 30.

Gear 90 has an upstanding integral pinion gear portion 96 with a hole formed therethrough for receiving a steel pin (not shown) about which the gear rotates. The steel pin has a press fit in a suitable hole provided in base 30. The teeth of pinion gear portion 96 engage a further drive gear 100 having gear teeth 102 on the outer surface thereof. Gear 100 has a depending pinion gear portion 110 with a hole formed therethrough for receiving a steel pin (not shown) about which the gear rotates. The steel pin has a press fit in a suitable hole provided in base 30. The teeth of pinon gear portion 110 engage teeth 112 formed on the outer surface of a driven transfer gear 114. The undersurface of gear 110 is supported on the support surface 60 of base 30.

There are seven transfer gears all of which are identical in construction with one another. As seen in FIG. 5, these transfer gears are numbered 114, 116, 118, 120, 122, 124 and 126. These gears may be made of high impact polystyrene plastic. Since the gears are identical, a description of one of the transfer gears will suffice for all. Transfer gear 114 includes a central hub 130 with three radial spokes 132 connected to an outer ring 134 having teeth formed on the outer periphery thereof. Three equally spaced slots 136 extend through the ring.

The transfer gears have the teeth on the outer surfaces thereof in contact with one another as shown in FIG. 5. The hubs of each of the transfer gears is rotatably mounted on an integral cylindrical post extending upwardly from the support surface 60 of base 30. Four of these posts 140, 142, 144 and 146 are shown in FIG. 6. The direction of rotation of the various elements which are driven by the motor are shown in FIG. 5.

Three plant supports or discs 150, 152 and 154 can be seen in FIGS. 1 and 6, these discs being of identical construction and being formed of high impact polystyrene plastic. As seen particularly in FIG. 6, discs 150, 152 and 154 are drivingly associated with transfer gears 126, 120 and 118 respectively. Each disc has a slidable drive connection with its associated transfer gear as hereinafter described.

Since the discs are identical and the driving connections between each disc and its associated transfer gear are also identical, a description of one disc and its driving connection to its transfer gear will suffice for all.

Referring to FIGS. 10–13, disc 150 has a cross-sectional configuration as shown in dotted lines in FIG. 10. The disc has three identical equally spaced downwardly extending projections indicated generally by reference numerals 160. Each projection includes a flattened body portion 162 having an outer dimension which is adapted to be disposed within a slot in transfer gear 126 with small clearance so that the projection is relatively snugly yet slidably disposed within a slot 164 formed through the transfer gear, it being understood that three slots 164 are provided in spaced relationship to receive the three body portions 162.

The bottom edge 166 of body portion 162 is rounded so as to provide a substantially line contact with support surface 60 of the base 30. Gusset portions 168 and 170 extend at right angles to the flattened body portion 162 and serve to reinforce such body portion. The support surface 60 of the base includes a plurality of generally circular surface portions 172 each of which is highly polished to minimize friction with the lower surface 166 of the associated projection. One such polished portion is shown in dotted lines 172 in FIG. 6 and the width thereof is also indicated by the bracket beneath FIG. 12. The undersurfaces of the gussets provide stop surfaces 168' and 170' which are normally spaced from the associated transfer gear 126 and is adapted to engage the gear and limit movement of the transfer gear in an upward direction.

It is noted that the disc is normally supported on the base solely by the lower ends 166 of projections 160, body portions 162 and the slots in the transfer gears through which they extend providing a sliding driving connection since body portions 162 can slide vertically up and down in the slots during operation.

Disc 150 is also provided with an integral depending cylindrical protuberance 180 which is provided with two diametrically extending slots 182 and 184 which intersect with one another to provide a flexible protuberance which can expand and contract when subjected to radial forces. The lower end of the protuberance has an external configuration as seen in FIG. 10 which defines a shoulder 186 extending around the protuberance.

A rigid receptacle is defined by post 140 which includes an upwardly extending tubular portion 190 which has a downwardly and inwardly tapering opening 192 at the top thereof, the opening terminating in an annular shoulder 194. When protuberance 180 is inserted within tubular portion 190, the lower end of the protuberance will be forced inwardly as the protuberance moves downwardly until the lower end of the protuberance snaps outwardly and shoulder 186 engages shoulder 194. In this position, movement of the disc away from the base is limited, but the disc may be detached from the base by pressing the protuberance radially inwardly so that shoulder 186 on the protuberance clears shoulder 194 whereupon the disc can be removed from the base.

It is noted that post 146 and the post which supports gear 118 are similar in construction to post 140 so as to receive protuberances formed on the associated discs 152 and 154 respectively whereby each of the discs is limited in its movement away from the base. The remaining posts are simply cylindrical in construction so as to rotatably support the associated transfer gears.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A solar powered rotating plant supports device comprising, a housing, a plurality of plant supports spaced from one another and being rotatably supported by said housing and adapted to support plants thereon, an electric motor supported by said housing, solar cell means supported by said housing and electrically connected to said motor for driving said motor, a drive train drivingly connecting said motor to said plant supports so that adjacent ones of said plant supports rotate in opposite directions whereby portions of the plants which overlap one another move in the same direction and mesh together rather than pushing against one another to minimize any damage to one another.

2. A device as defined in claim 1 wherein said plant supports include three separate supports with an intermediate support disposed between the other two supports, said intermediate support rotating in one direction while the other two supports rotate in directions opposite to that of the intermediate support.

3. A device as defined in claim 1 wherein said drive train includes a slidable driving connection between each plant support and an associated transfer gear, each slidable driving connection including a projection on a plant support, a slot formed through an associated transfer gear, and said projection extending slidably through said slot.

4. A device as defined in claim 3 including means for detachably connecting each plant support with said housing for limiting movement of each plant support away from said housing.

5. A device as defined in claim 4 wherein said detachable connecting means comprises a rigid receptacle and a flexible protuberance for reception in said receptacle.

6. A device as defined in claim 3 wherein said projection is disposed within said slot with small clearances so that the projection is relatively snugly disposed within said slot.

7. A device as defined in claim 3 wherein said housing includes a support surface, each projection having a curved lower surface which provides a substantially line contact with said support surface.

8. A device as defined in claim 7 wherein said support surface includes a plurality of generally circular surface portions each of which is highly polished to minimize friction with the lower surface of an associated projection.

9. A device as defined in claim 3 wherein each of said projections has a stop surface formed thereon which is normally spaced from an associated transfer gear and is adapted to engage an associated transfer gear and limit movement thereof if the associated transfer gear moves in an upward direction.

10. A device as defined in claim 1 wherein said drive train includes a first drive gear which is drivingly connected to said motor, said first drive gear being connected to a plurality of drive gears to provide a plurality of torque multiplication stages, a plurality of similar transfer gears drivingly connected to one another and including a driven transfer gear which is drivingly connected to said plurality of drive gears, and certain ones of said plurality of transfer gears being drivingly connected to associated plant supports.

11. A device as defined in claim 10 wherein said motor has an output shaft having a roller drivingly connected thereto, said first drive gear having a raised peripheral edge thereon for drivingly engaging said roller.

12. A device as defined in claim 10 wherein said housing includes a support surface, each of said transfer gears being rotatably supported on said support surface.

* * * * *